US005567193A

United States Patent [19]

Blecker

[11] Patent Number: 5,567,193

[45] Date of Patent: Oct. 22, 1996

[54] ARRANGEMENT FOR VACUUM-TIGHT SEALING OF ELECTRON TUBES

[75] Inventor: Armin Blecker, Asslar, Germany

[73] Assignee: Balzers-Pfeiffer GmbH, Asslar, Germany

[21] Appl. No.: 464,484

[22] Filed: Jun. 5, 1995

[30] Foreign Application Priority Data

Jul. 18, 1994 [DE] Germany ..... 44 25 160.2

[51] Int. Cl.[6] ..... H01J 9/385; H01J 9/40

[52] U.S. Cl. ..... 445/70; 445/73; 141/65

[58] Field of Search ..... 445/70, 73; 141/65

[56] References Cited

U.S. PATENT DOCUMENTS 2,278,500 4/1942 Smith ..... 445/73

5,435,767 7/1995 Miyake et al. ..... 445/70

*Primary Examiner*—P. Austin Bradley
*Assistant Examiner*—Jeffrey T. Knapp
*Attorney, Agent, or Firm*—Anderson, Kill, Olick P.C.

[57] ABSTRACT

An arrangement for vacuum-tight sealing of electron tubes is provided with a vacuum pipe system which is connected to the electron tube by a tubularly-shaped connecting element. The connecting element is sealed in a vacuum-tight manner by a special thermal seal-off or melt-down unit after the electron tube has been evacuated. The thermal seal-off or melt-down unit is provided with a heating coil which is embraced by a component. The component is provided with an arresting element so that the component can be easily removed from the thermal seal-off or melt-down unit.

2 Claims, 1 Drawing Sheet

ARRANGEMENT FOR VACUUM-TIGHT SEALING OF ELECTRON TUBES

FIELD OF THE INVENTION

The present invention is directed to an arrangement for vacuum-tight sealing of Electron or Thermionic tubes, for instance, image reproduction or rendition tubes.

BACKGROUND OF THE INVENTION

Electron tubes are evacuated by pumping systems specifically suited for the respective production process. Glass-covered tubes are, as a rule, connected to the pumping systems by glass tubes. These glass tubes, called pumping leads in technical terminology, are severed from the pumping system after the evacuation through ablation or melt-down. The portion of the pump lead facing the tube remains a component of the tube base upon which the internal components of the tube are installed. For large scale series manufacture, a device is used for the ablation process which is designated as a seal-off unit.

The seal-off unit consists of several parts which, until now, were assembled in axial direction to correspond with the drawing in FIG. 1. In the configuration of FIG. 1, an electron tube 1 is evacuated by a pumping system 2. The connection between the electron tube and the pumping system is formed by a tubularly-shaped component 4 which is called the pump lead-in or exhaust tube. In order to make the conductance in the pump lead-in or exhaust tube as large as possible and to thus limit the pump-down time to a minimum, the lead-in tube must be as short as possible. This means that the electron tube base 16 and the pumping system 2 must be disposed closely together. The sealing-off unit 5 is located between the electron tube base 16 and the pumping system 2. It consists of a housing 6 with cover 8, various installation elements 9, 10, 11 and heating coil 6.

The sealing-off unit must be disassembled if it is desired to replace the heating coil. This occurs in axial direction after disconnecting the bolts 12. The close axial construction and attachments 3, which is necessary for reasons mentioned above, with the attachment 3 being required for handling the electron tube and its components during the pump-down process, make the disassembly extremely complicated and time consuming.

The heating coil is a part which is exposed to high thermal loading and thus considerable wear. This postulates frequent replacement of this component. The replacement of these components and other maintenance processes are a considerable burden involving effort and time in case of mass production. A rapid and rational progress of this manufacturing process is to be aimed at. This could be only unsatisfactorily solved with the conventional designs as has been demonstrated above.

SUMMARY OF THE INVENTION

The task of the present invention is to design the seal-off unit in such a way that, within the framework of mass production, the replacement of the heating coil and other maintenance processes can be accomplished without great effort, time expenditure and expense.

The present invention is directed to an arrangement for vacuum-tight sealing of electron tubes by a vacuum pump system and a tubularly-shaped connecting element between the electron tube and the vacuum pumping system. The arrangement is permanently sealed in a vacuum-tight manner by thermal seal-off after the electron tube has been evacuated, wherein the seal-off process is performed by a special thermal seal-off unit, which is equipped with a heating coil. The heating coil is radially and axially embraced by a housing and a component of the housing can be removed sideways. The heating coil can also be removed together with the component without having to disconnect the bolt connections. An arresting element, for instance a spring, exists for holding or retaining the component.

Due to the design in the invention, it is feasible to disassemble and reassemble the seal-off or melt-down unit in radial direction in a simple manner without tools if it is desired to replace the heating coil.

The present invention is described as being utilized with electron or thermionic tubes, without however being limited to the vacuum-tight sealing of electron tubes. The present invention can be applied to all containers, which must be sealed permanently in a vacuum-tight manner by the thermal sealing-off process.

Accordingly, it is an object of the present invention to provide an arrangement for vacuum-tight sealing of electron tubes by a vacuum pump system and a tubularly-shaped connecting element between the electron tube and the vacuum pumping system.

It is another object of the present invention to provide an arrangement for vacuum-tight sealing of electron tubes, wherein it is feasible to disassemble and reassemble the seal-off or melt-down unit in radial direction in a simple manner without tools if it is desired to replace the heating coil.

It is still another object of the present invention to provide an arrangement for vacuum-tight sealing which can be applied to all containers which must be sealed permanently in a vacuum-tight manner by the thermal sealing-off process.

Other objects and advantages of the present invention will be apparent to those skilled in the art upon a review of the Description of the Preferred Embodiment taken in conjunction with the drawings which follow.

DESCRIPTION OF THE PREFERRED EMBODIMENT

Figure 1:
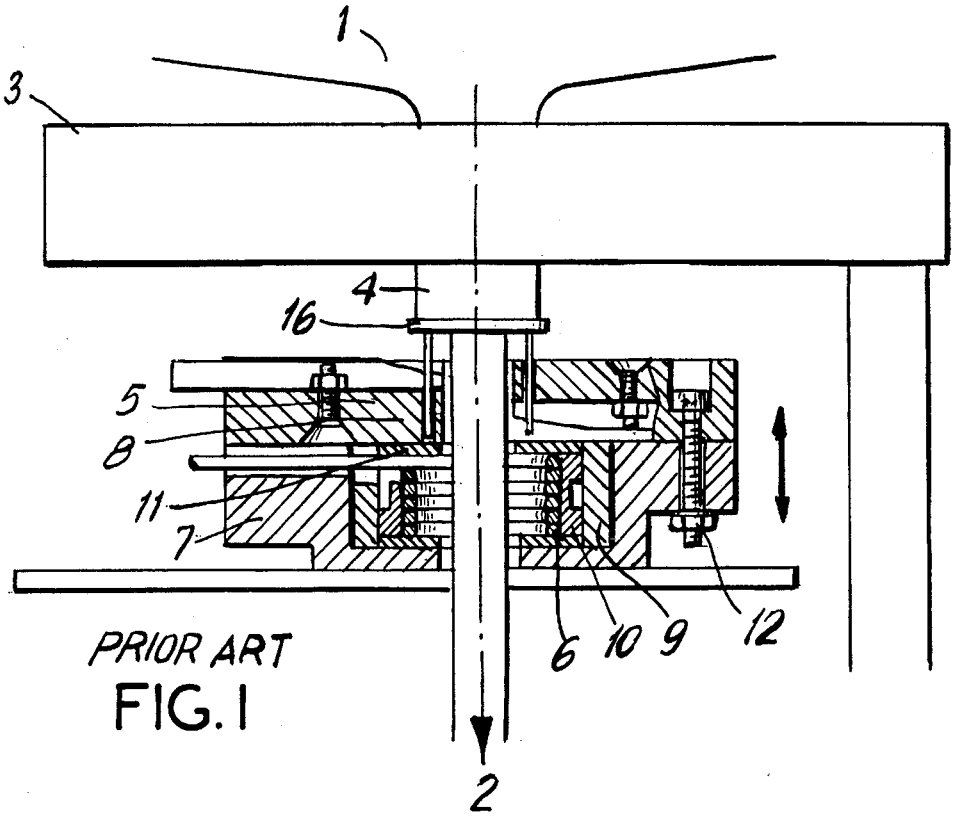
PRIOR ART FIG. 1
FIG. 1 illustrates a seal-off unit of the prior art which is an axial direction configuration.
Figure 2:
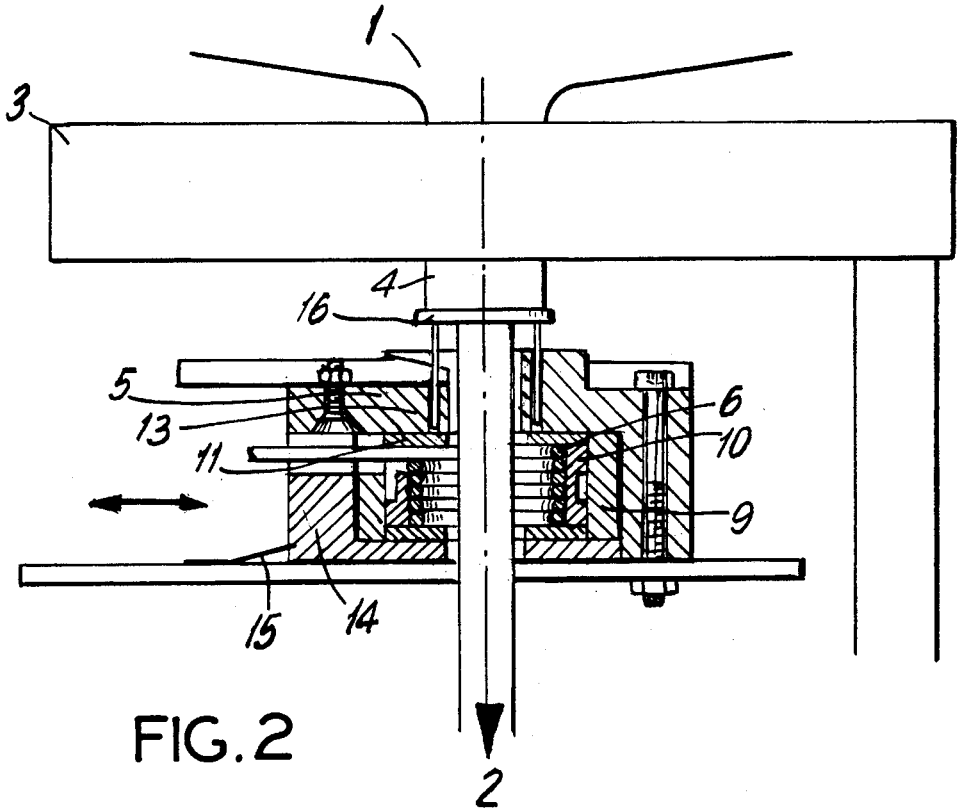
FIG. 2 illustrates an arrangement for vacuum-tight sealing of electron tubes which is the subject of the present invention.

The subject matter of the present invention is illustrated in FIG. 2. In FIG. 2, the elements which are common to both FIGS. 1 and 2 are designated by their respective reference numerals which are defined above.

In FIG. 2, the thermal sealing-off unit is designed in such a way that it must no longer be disassembled in an axial direction. It consists of the housing 13 comprising the heating coil 6 and the insulation elements in an axial direction. A component 14 of the housing 13 can be removed sideways. The heating coil 6 and the insulation elements can also be removed together with this component without having to disconnect the bolted connections. The entire thermal seal-off unit is held together by an arresting element 15, which is, for instance, a spring which must be released prior to removing the component 14.

While the present invention has been described and illustrated in a preferred embodiment, such is merely illustrative of the present invention and is not to be construed to be a limitation thereof. Accordingly, the present invention includes any and all modifications, variations and/or alternate embodiments with the scope of the present invention limited only by the claims which follow.

What is claimed is:

1. An arrangement for vacuum-tight sealing of an electron tube, which comprises:

a vacuum pump system;

a tubularly-shaped connecting element connectable between the electron tube and said vacuum pumping system;

a thermal seal-off unit, wherein said thermal seal-off unit is equipped with a heating coil;

a housing, wherein said housing further comprises a component which can be removed sideways; and an arresting element;

wherein the electron tube is permanently sealed in a vacuum-tight manner by said thermal seal-off unit after the electron tube has been evacuated, wherein said heating coil is radially and axially embraced by said housing, wherein said heating coil can also be removed together with said component of said housing without having to disconnect bolt connections, and wherein said arresting element exists for one of holding and retaining said component of said housing.

2. The arrangement of claim 1, wherein said arresting element is a spring.

* * * * *